US008360776B2

(12) United States Patent
Manard et al.

(10) Patent No.: US 8,360,776 B2
(45) Date of Patent: Jan. 29, 2013

(54) SYSTEM AND METHOD FOR CALCULATING A PROJECTILE IMPACT COORDINATES

(75) Inventors: Paige Manard, Richmond, TX (US); Charles Doty, Sugar Land, TX (US)

(73) Assignee: Laser Shot, Inc., Stafford, TX (US)

( * ) Notice: Subject to any disclaimer, the term of this patent is extended or adjusted under 35 U.S.C. 154(b) by 176 days.

(21) Appl. No.: 11/931,059

(22) Filed: Oct. 31, 2007

(65) Prior Publication Data

US 2008/0213732 A1 Sep. 4, 2008

Related U.S. Application Data

(63) Continuation-in-part of application No. 11/581,918, filed on Oct. 17, 2006, now abandoned.

(60) Provisional application No. 60/776,002, filed on Oct. 21, 2005.

(51) Int. Cl.
*F41G 3/26* (2006.01)

(52) U.S. Cl. ..... 434/23; 434/16; 434/17; 434/19

(58) Field of Classification Search ..... 434/16–17, 434/19, 20, 21, 23, 18, 11, 12, 24, 28
See application file for complete search history.

(56) References Cited

U.S. PATENT DOCUMENTS

| | | | | |
|---|---|---|---|---|
| 2,925,582 | A | 2/1960 | Mattei | |
| 3,402,933 | A | 9/1968 | Vogelacre | |
| 3,778,059 | A | 12/1973 | Rohrbaugh | |
| 3,849,910 | A | 11/1974 | Greenly | |
| 4,223,454 | A * | 9/1980 | Mohon et al. | 434/20 |
| 4,253,670 | A | 3/1981 | Moulton et al. | |
| 4,260,160 | A | 4/1981 | Ejnell et al. | |
| 4,261,579 | A | 4/1981 | Bowyer | |
| 4,281,241 | A | 7/1981 | Knight | |
| 4,349,728 | A | 9/1982 | Phillips | |
| 4,425,500 | A | 1/1984 | Knight | |
| 4,514,621 | A | 4/1985 | Knight | |
| 4,553,943 | A | 11/1985 | Ahola | |
| 4,657,511 | A * | 4/1987 | Allard et al. | 434/20 |
| 4,680,012 | A * | 7/1987 | Morley et al. | 434/22 |
| 4,799,688 | A | 1/1989 | Kellamn | |
| 4,820,161 | A * | 4/1989 | Wescott | 434/16 |

(Continued)

FOREIGN PATENT DOCUMENTS

GB 2 264 358 * 8/1993

OTHER PUBLICATIONS

Non-Final Office Action for related U.S. Appl. No. 11/581,918 mailed Sep. 15, 2009.

(Continued)

*Primary Examiner* — Xuan Thai
*Assistant Examiner* — Bruk Gebremichael
(74) *Attorney, Agent, or Firm* — Sutherland Asbill & Brennan LLP

(57) ABSTRACT

A training system and method to calculate actual coordinates of a projectile impact at one or more screens has been disclosed. A projectile is launched at a screen. One or more targets are projected onto the screen. A calibrated sensor is directed at the screen surface. The sensor continually captures thermal images of a screen surface. The sensor comprises software to detect and isolate thermal images of the projectile impacting the screen. These impact images are transmitted to a computer connected to the sensor. A computer comprises software to calculate the actual impact coordinates relative to a projected target. The calculated coordinates are digitally sent to feedback devices for display purposes. The system further comprises virtual training scenarios that are triggered upon notification of actual impact coordinates. These training scenarios simulate real life situations.

18 Claims, 4 Drawing Sheets

U.S. PATENT DOCUMENTS

| | | | | |
|---|---|---|---|---|
| 5,025,424 | A | 6/1991 | Rohrbaugh | |
| 5,281,142 | A | 1/1994 | Zaenglein, Jr. | |
| 5,366,229 | A | 11/1994 | Suzuki | |
| 5,501,467 | A | 3/1996 | Kandel | |
| 5,551,876 | A | 9/1996 | Koresawa et al. | |
| 5,566,951 | A | 10/1996 | Dart | |
| 5,649,706 | A | 7/1997 | Treat, Jr. et al. | |
| 5,823,779 | A * | 10/1998 | Muehle et al. | 434/21 |
| 5,924,694 | A | 7/1999 | Kent | |
| 5,980,254 | A | 11/1999 | Muehle et al. | |
| 5,999,210 | A | 12/1999 | Nemiroff | |
| 6,012,980 | A | 1/2000 | Yoshida et al. | |
| 6,198,501 | B1 | 3/2001 | Nemiroff | |
| 6,260,466 | B1 | 7/2001 | Humphreys | |
| 6,367,800 | B1 | 4/2002 | Sheck et al. | |
| 6,536,907 | B1 | 3/2003 | Towner et al. | |
| 6,604,064 | B1 * | 8/2003 | Wolff et al. | 703/7 |
| 6,840,772 | B1 | 1/2005 | Pura | |
| 7,094,164 | B2 * | 8/2006 | Marty et al. | 473/416 |
| 2002/0051953 | A1 | 5/2002 | Clark et al. | |
| 2002/0064764 | A1 * | 5/2002 | Fishman et al. | 434/252 |
| 2002/0107069 | A1 | 8/2002 | Ishino | |
| 2003/0157463 | A1 | 8/2003 | Watanabe et al. | |
| 2003/0228557 | A1 | 12/2003 | Abe | |
| 2005/0123883 | A1 * | 6/2005 | Kennen et al. | 434/11 |
| 2006/0061571 | A1 * | 3/2006 | Nomura et al. | 345/427 |
| 2007/0026364 | A1 | 2/2007 | Jones et al. | |
| 2008/0192129 | A1 | 8/2008 | Walker et al. | |

OTHER PUBLICATIONS

Final Office Action for related U.S. Appl. No. 11/581,918 mailed Apr. 14, 2010.

Non-Final Office Action for related U.S. Appl. No. 11/581,918 mailed Feb. 1, 2011.

Final Office Action for related U.S. Appl. No. 11/581,918 mailed Jul. 19, 2011.

* cited by examiner

SYSTEM AND METHOD FOR CALCULATING A PROJECTILE IMPACT COORDINATES

PRIORITY

This application claims the benefit of priority from U.S. Provisional Patent Application No. 60/776,002 filed Oct. 21, 2005 and is a continuation-in-part of U.S. patent application Ser. No. 11/581,918 filed Oct. 17, 2006.

FIELD OF INVENTION

The present invention relates to a system and method for determining the actual coordinates of a projectile impact. Particularly, the invention is directed to firearms and weapons training systems.

BACKGROUND

Military personnel, police and other law enforcement officers, hunters, sportsmen and especially ordinary citizens need extensive training prior to handling weapons or firearms. When training military and law enforcement personnel, in particular, it is also important for the training systems to employ live weapons and for the immediate conditions to mimic or simulate real life conditions. In real-life situations, these personnel have very little reaction time to respond to multiple stimuli. A bullet or projectile that accurately hits its intended target may reduce, or even eliminate, collateral civilian and property losses. Interactive training systems, which aid in improving shot accuracy, have become very popular. To simulate realistic conditions any such training system must also provide multiple true-to-life scenarios without artificially enforced interruptions to identify the impact location.

Current training systems use a simulated weapon firing a simulated projectile at traditional or virtual targets. Targets are then imaged on a video projection screen. The location of a projectile impact is determined visually or is roughly estimated. These simulators use a beam of light to simulate the projectile and the path of the projectile. The light beam is a narrowly focused beam of visible light or near infrared light, such as those wavelengths produced by low energy laser diodes, which can then be imaged by conventional video cameras or imagers. Sometimes a filter is used to enhance the ability of these cameras to discern the normal reflected light and the light from the simulated projectile. These simulators do not allow for the use of live projectiles, such as bullets. Live projectiles can be used in shooting ranges with virtual targets projected on the backstop or targeting screen. The hit or impact locations can be determined; however, the shooter has to constantly stop to gauge shot accuracy.

Targets are typically made of paper, plastic, cardboard, polystyrene, wood and other tangible materials. Softer materials, such as paper, allow for easy monitoring of impact location as shown by the hole created in the material, but the projectiles quickly destroy these materials. Metal targets are more durable; however, their intrinsic hardness creates difficulty in determining the actual impact location. Self-healing elastomeric materials, like rubber, fall somewhere in between—they are more durable than the softer materials, but determining the exact impact coordinates is not very easy. Training simulators were developed to simulate continuous action and overcome some of the disadvantages associated with shooting at traditional targets. However, these simulators require the use of simulated weapons. Simulated weapons do not accurately convey the feel and recoil action of firearms. Trainees, not used to extensive target practice with live firearms, may be disadvantaged when required to handle firearms in combat situations. Current training simulators use technology that limits realism and the ability for through performance measurement.

A variety of methods have been disclosed in the prior art to detect the impact location of live projectiles. Most of these methods require direct or visual inspection by the shooter or trainee. Prior art methods detect holes, cold spots, spots of light or supersonic waves. Other methods calculate trajectories or monitor changes in electrical properties at the impact zone in order to estimate the impact location. The impact location of a projectile can be determined directly by locating the point of impact or penetration visually on the target itself. For example, paper or cardboard targets would show a hole in the target corresponding to the location of penetration of the projectile. Metal targets may show a hole, indentation, or surface mark where the projectile impacted or penetrated. These methods have limitations. They may only be used a limited number of times before the target is destroyed. If they are impacted multiple times, it becomes difficult to determine which shots correspond to which hole. To observe the target holes from a distance, telescopic optical means must be employed by the user or a spotter to detect hit location. To directly observe the impact location, the target must be observed up close, by approaching the target, or by mechanically retrieving the target. This requires stopping the training and increases the safety risk of the trainee. Furthermore, all systems using a fixed target are limited in size and maneuverability either in side-to-side motion or in front to back motion. In order to get around these limitations, several alternative methods have been suggested in the prior art to detect impact location of a projectile on a target without having to observe the target at close range. These methods include employing a backlit screen which, when penetrated by a projectile, shows a bright spot from the backlight; using acoustic sensors which detect the shock wave from the passing projectile; or using thermal means of heating the target to a uniform temperature and then looking for cold holes left by the penetrating projectile.

However, these methods only estimate impact coordinates. And, the fixed targets used in these training methods possess limited maneuverability. Finally, the trainee does not get to realistically experience the possible after effects of a projectile impact.

SUMMARY

This invention relates to a system and method for calculating the actual pixel coordinates of a projectile launched from a projectile launching device, such as a firearm. In one embodiment, a sensor is used to capture images of the energy changes, or spikes, across a planar surface. The planar surface comprises one or more screens capable of displaying one or more targets. In this embodiment, the screen comprises a self-healing, elastomeric material. Targets can comprise live video, computer graphics, digital animation, three-dimensional images, two-dimensional images, virtual targets and moving targets. When a projectile impacts or penetrates the one or more screens, one or more sensors register the impact by virtue of a corresponding change in energy across screen surface. In one embodiment, the sensor is a thermal camera.

The sensor is connected to a computer. The system is calibrated such that the computer has enough information to translate coordinates from a three-dimensional plane defined by the target to logical virtual screen coordinates that can be used by the computer's operating system. The computer further comprises software to calculate the exact pixel coordinates of the projectile impact from the logical virtual screen coordinates. Once the pixel coordinates have been calculated, the computer relays this information to the trainee using feedback mechanisms comprising a projector, monitor or any other electronic device capable of receiving and visually or graphically displaying this information. The process of calculating the impact coordinates and relaying the information back to the trainee is limited only by the computer's processing speed, and the process is virtually instantaneous.

In another embodiment, the system comprises a device such as a video player capable of recording and playing back true-to-life simulated training scenarios. A computer transmits information about the impact coordinates to the video player. The video player selects a scenario that depicts the after-effects or outcome of a projectile accurately hitting, nearly hitting or missing a target. The scenarios can be projected onto a screen or displayed on a monitor or any other feedback device.

The invention does not involve detecting holes or damage to the target to determine impact location, nor is the impact estimated from a determination of the projectile trajectory. Sensors comprising image sensors and/or thermal sensors are used to detect an impact based on changes in energy at a screen surface. In another embodiment, a sensor comprises software to isolate thermal images of a projectile impacting a screen surface from continually captured thermal images of the screen surface. The isolated thermal images are sent to a computer attached to the sensor. A computer receives these coordinates as mouse clicks. The computer can calculate actual projectile impact coordinates, relative to a projected target on the screen surface, from the impact images transmitted by the sensor. In certain embodiments, an actual impact coordinate calculator, e.g. a computer with appropriate software or an additional, separate, dedicated device such as a microprocessor or ASIC, is adapted to use the images received from a camera such as a thermal camera and a set of calculated environmental effects to calculate a set of impact coordinates relative to the projected target in real time.

The invention can also be adapted to assist users of other types of projectile launchers such as bows, crossbows, spears, darts, balls, rocket launchers or other projectile launching devices, such as by detecting the heat energy transferred to a target upon impact or penetration.

This combination of accurately measuring the impact coordinates and conveying potential outcomes using training scenarios aids in creating a realistic training experience. The invention improves the effectiveness and realism for training the military, police officers, marksmen, sportsmen or other firearm users, in a simulated environment using real weapons with real ammunition, by detecting the heat transferred to a target upon impact or penetration of the target by the projectile. The invention is effective because the training does not need to be halted to determine the impact location. The realism is improved because the trainee does not have to use a simulated or demilitarized weapon in training. Since actual weapons and ammunition can be adapted for use with the system, the trainee experiences the sounds, recoil and discharge associated with the trainee's own weapon. The trainee is thus better able to handle real-life situations. The invention allows the trainee to determine the impact location without approaching the target. This aids in safer training because the trainee is not required to be within the range of fire to view where the projectile impacted a target.

DETAILED DESCRIPTION OF PREFERRED EMBODIMENTS

Figure 1:
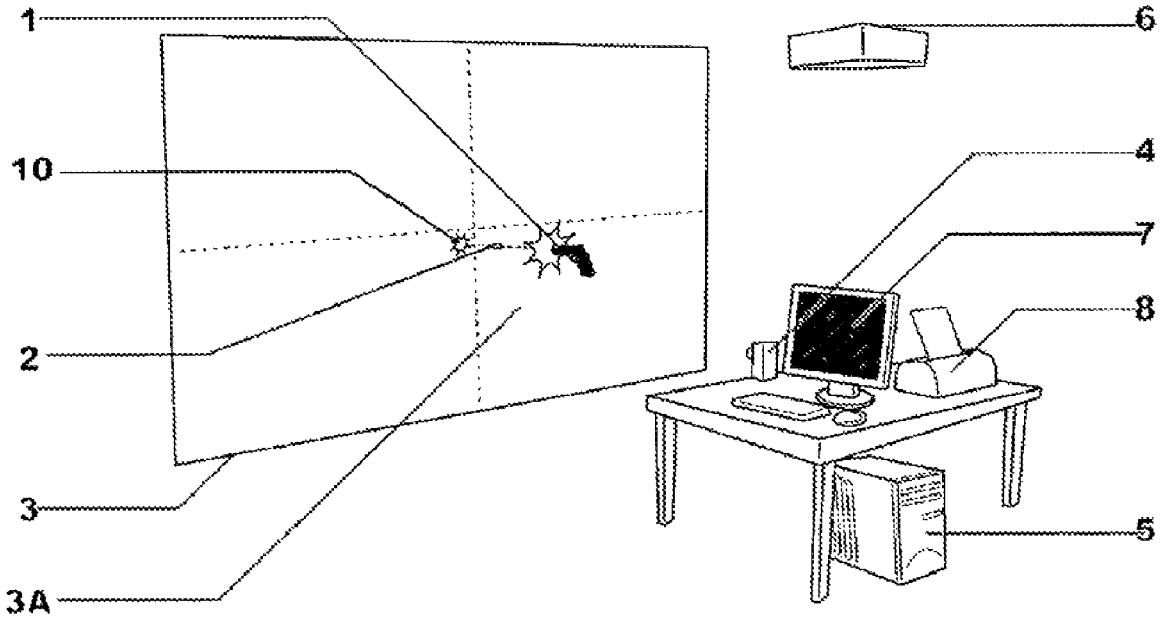
FIG. 1 shows a schematic of a training system to detect the actual projectile impact coordinates.

In a preferred embodiment, a training system detects actual coordinates of projectile 2 launched at one or more targets 20 (FIG. 3) which are projected onto one or more screens 3 onto which two- or three-dimensional representations of terrain or other scenes are also projected. Targets 20 comprise representations of virtual targets, live video, computer graphics, digital animation, three-dimensional images, two-dimensional images and moving targets for receiving the projectile impact. FIG. 1 shows an embodiment of the system comprising calibrated sensor 4 capable of detecting energy changes, e.g. spikes, at the point of impact on screen 3 when projectile 2 impacts screen 3. Sensor 4 captures images of the energy spikes on surface 3*a* of screen 3 and relays them to an attached computer 5. Computer 5 comprises software adapted to calculate the actual coordinates of projectile impact 10 based on the images transmitted by sensor 4. The software may further comprise an environmental factoring module adapted to provide real-time calculation of an effect of a predetermined set of environmental characteristics on an object located within the three dimensional virtual space, including target 20 or background scene objects. These predetermined set of environmental characteristics may include wind, distance, air density, object density, gravity, or the like, or a combination thereof.

In certain embodiments, motion detector 50 is present and interfaces with a motion detection software module, e.g. software resident in computer 5. Using positional information of the projectile detected by motion detector 50, the motion detection software module can determine a position of a projectile releasing device, e.g. projectile launching device 1, at the instant that the projectile releasing device fires projectile 2. Actual impact coordinate calculator, e.g. software operating within computer 5, can then use the detected position of the projectile releasing device while calculating the set of impact coordinates relative to projected target 20 in real time.

Figure 2:
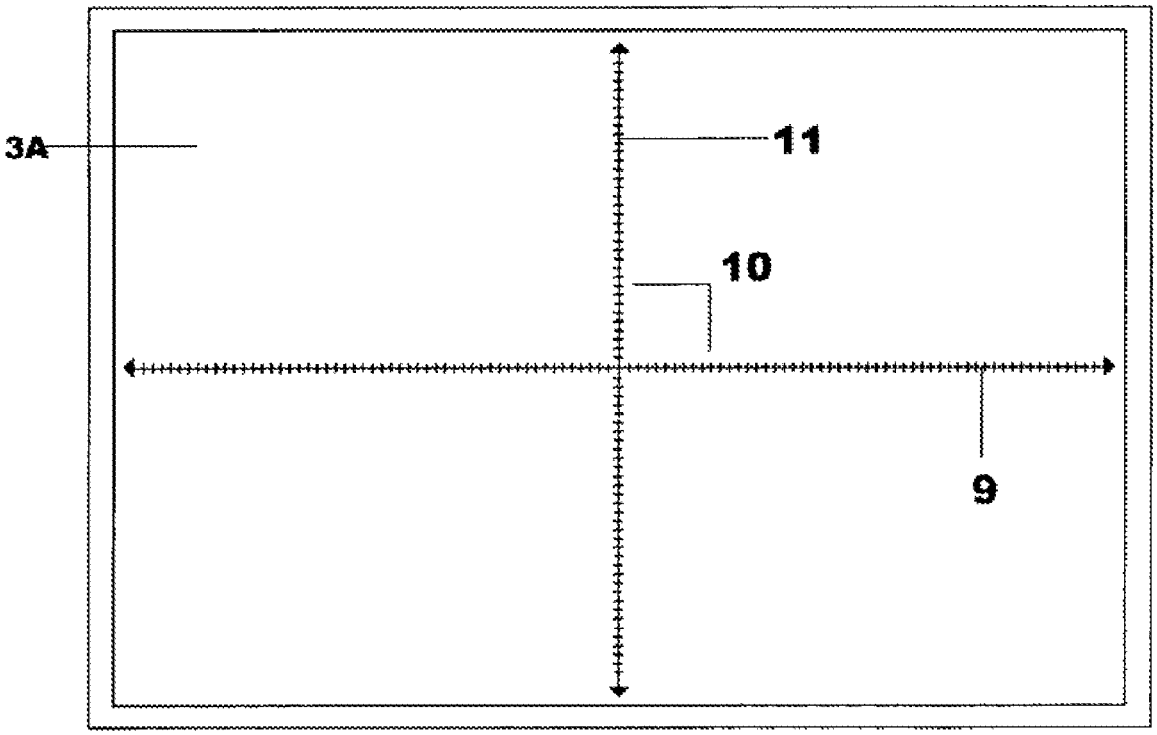
FIG. 2 shows a schematic of the actual impact coordinates projected onto a screen.
Figure 3:
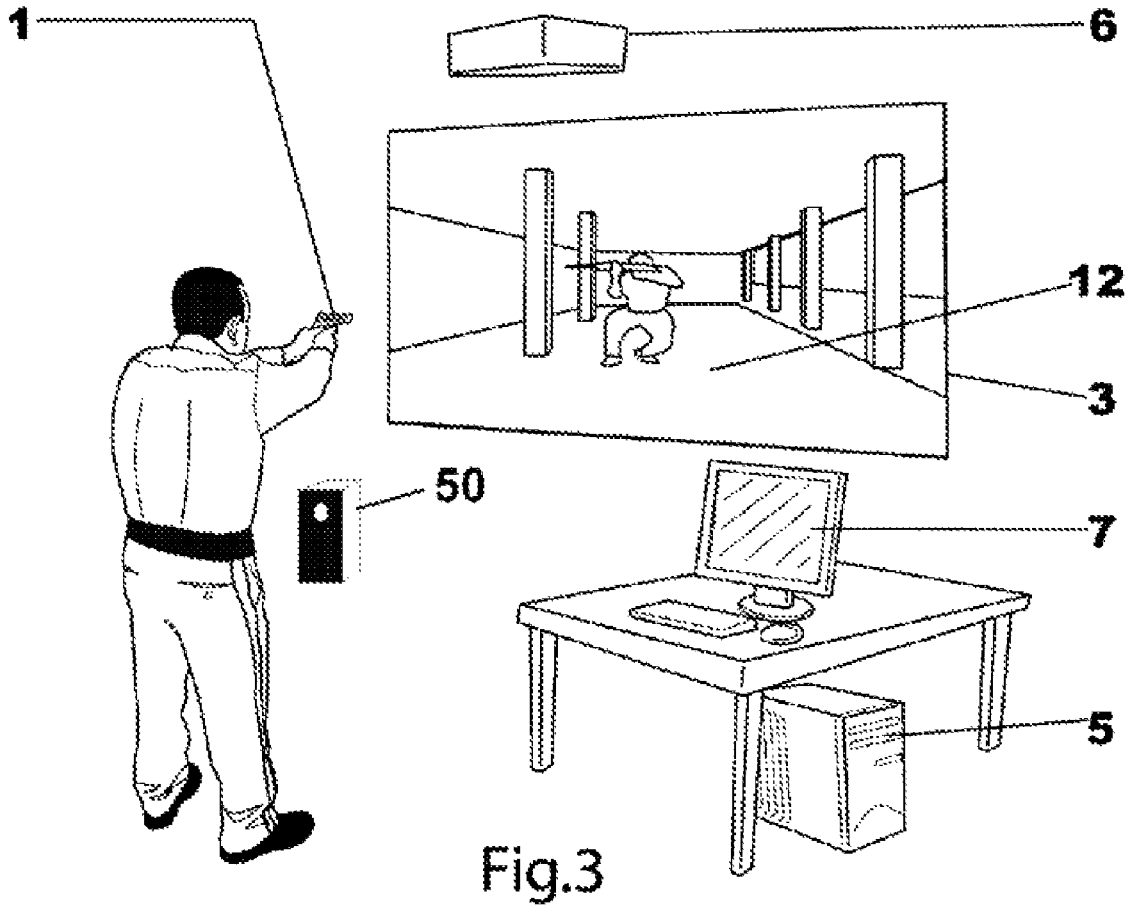
FIG. 3 shows a simulated training scenario.
Figure 4:
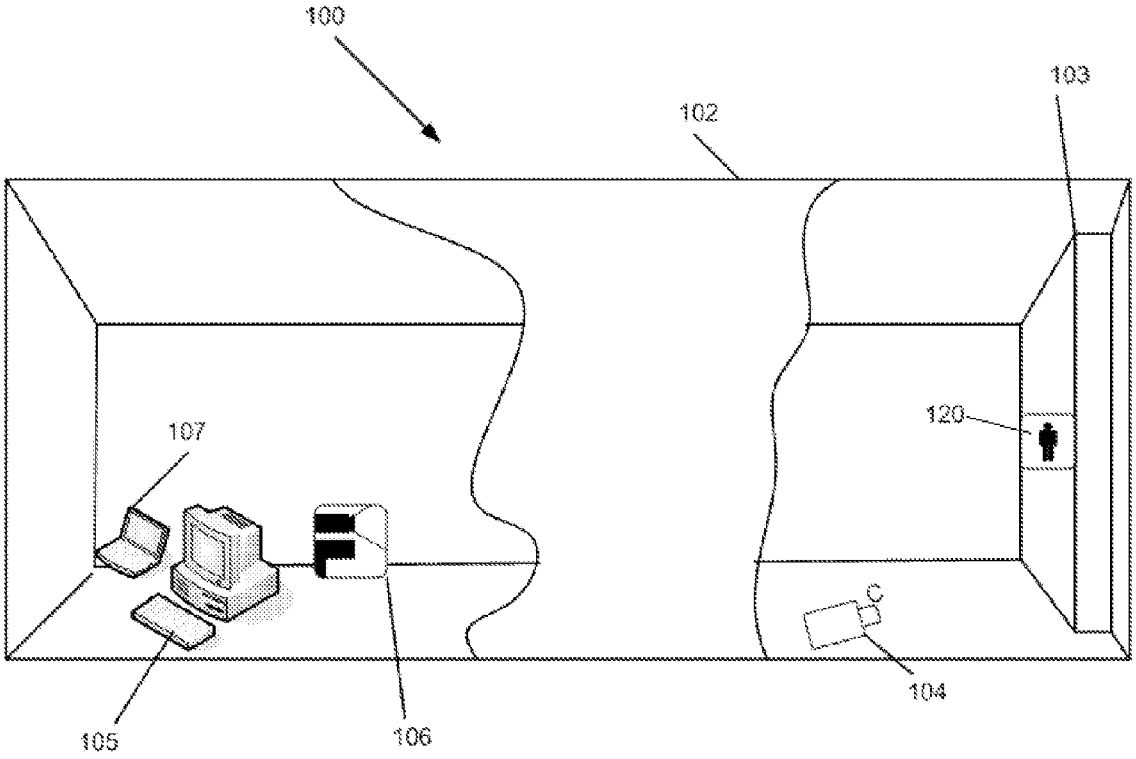
FIG. 4 illustrates an exemplary portable shooting range comprising a housing and a container in partial cutaway perspective.

FIG. 1 further illustrates the use of one or more feedback devices. The feedback devices can comprise projector 6 for displaying the coordinates onto screen 3, monitor 7 connected to computer 5, printer 8 connected to computer 5, or similar electronic devices capable of receiving digital signals from computer 5, or a combination thereof. Feedback devices such as monitor 7, projector 6 and printer 8 can translate the digital signals virtually instantaneously into visual or graphical representations of the calculated projectile impact coordinates 10. FIG. 2 depicts impact coordinates 10 of the impact of projectile 2 along a virtual X-axis 9 and a virtual Y-axis 11 projected onto screen 3. In a preferred embodiment, the system further comprises software that can display simulated training scenarios 12 on screen 3, as depicted in FIG. 3. Training scenarios 12 depend upon the calculated impact coordinates. For example, where impact coordinates 10 reflect that target 20 (FIG. 3) was moving and was missed, training scenario 12 may then show target 20 as continuing to move rather than become immobilized. The displayed training scenarios 12 may be selected according to further actions required. Referring now additionally to FIG. 4, in a currently envisioned embodiment, the system is portable and can be used in indoor shooting ranges or in limited spaces where the ambient lighting is not easily reflected. Alternatively, referring still to FIG. 4, the system can comprise a portable shooting range comprising housing 100 which comprises container 102. Containerized housing 100 further comprises screen 103 for displaying projected targets 120, thermal camera 104, computer 105, projector 106, and monitor 107 for providing immediate feedback. Advantageously, the containerized system can be transported for on-site training. The system finds application in various law enforcement training situations like sniper, artillery, weapons and sharpshooter training.

Referring back to FIG. 1, almost any projectile launching device 1 can be adapted for use with the invention. These devices comprise chemically or explosive powered devices such as firearms; pneumatic or compressed gas or spring-piston powered devices; elastic or spring tension powered devices; laser guns; bows; and any other device capable of launching projectiles.

Various types of projectiles 2 may be deployed with this invention. The type of projectile 2 used depends on the training requirements. Projectiles 2 may comprise bullets, including lead bullets, copper jacketed bullets, steel jacketed bullets, tracer bullets, frangible bullets, plastic bullets, shotgun shot of various sizes and materials, and shotgun slugs. Softair pellets, metal or plastic pellets, metal or plastic BBs, frangible pellets, arrows, spears, darts, stones, balls and hockey pucks, lasers, rockets, missiles, grenades and other objects, now known or later developed, that can leave a heat signature upon impact may be used as projectiles 2.

Projectiles 2 are launched at one or more screens 3. Screen 3 can be constructed from any of several materials comprising paper, cloth, plastic, metal or rubber. In a preferred embodiment, screen 3 comprises an elastomeric material such as rubber, vinyl, silicone or plastic. The flexible nature of elastomeric materials allows for various projectile types to impact the material and either bounce off or penetrate screen 3 while doing minimal damage to screen 3. Upon impact or penetration by projectile 2, certain types of elastomeric materials such as rubber will allow projectile 2 to open a hole the size of projectile 2, allow projectile 2 to pass through the material, and then close back up due to the elastic nature of the material. While the hole is still present in the material, it still presents a relatively smooth surface on front surface 3*a* of screen 3. Front surface 3*a* of screen 3 is preferably coated with a white or light colored reflective coating to allow one or more targets 20 (FIG. 3) to be projected upon it. The back surface of screen 3 is preferably set up against a bullet trap or ballistic material. Screen 3 is typically compact and can be hung on a wall of a shooting range or inside a containerized shooting range (e.g., FIG. 4). Screen 3 may comprise spring roller pull-down models, electrically operated types or the portable models. Screen 3 may be operated with remote controls or may be manually controlled. Screen sizes depend upon the distance between screen 3 and projector 6. In an alternative embodiment, any planar surface that can receive one or more projected images can act as screen 3. Examples of such surfaces include rock walls, concrete walls, and the like.

Projectiles 2 are launched at targets 20 (FIG. 3) projected on to screen surface 3*a*. These projected targets 20 can comprise digital animation, live videos, computer graphics, three-dimensional images, two-dimensional images; moving targets and other pictorial representations. Projected targets 20 may further comprise one or more virtual targets 20 for receiving the projectile impact. In certain embodiments, a predetermined number of targets 20 may move independently of a predetermined number of the other targets 20 within the simulated three dimensional space, including but not limited to moving randomly.

As illustrated in FIG. 1, the training system comprises sensor 4, preferably a thermal imaging sensor for capturing thermal images of screen surface 3*a*. Sensor 4 is directed at the front surface 3*a*. However, sensor 4 may be placed at an angle to screen 3, that is, to the left or right of the front of screen 3, directly in front of screen 3, looking down at screen 3, or positions other than perpendicular to the front of screen 3. Sensor 4 does not have to be able to detect the entire projected target 20 (FIG. 3). In one aspect of this invention, sensor 4 continually captures thermal images of screen 3. In one embodiment, sensor 4 comprises software that can detect projectile impact 10 on screen 3 by comparing current thermal images of screen surface 3*a* with previously captured baseline thermal images of screen surface 3*a*. Sensor 4 registers an impact, e.g. 10, when the current thermal images of screen 3 show a deviation from the captured baseline image. The deviation from the baseline is caused by the energy transferred to screen 3 during the impacting or penetrating of screen 3 by projectile 2. Sensor 4 transmits only the impact images to computer 5 for processing. Since sensor 4 does not transmit multiple thermal image frames to computer 5 for analysis of impact coordinates 10, the efficiency of the system is enhanced.

In another embodiment, sensor 4 comprises thermal camera 4 which comprises an infrared core that can detect heat across a predetermined energy spectrum, including the infrared region of the energy spectrum. In one embodiment, thermal camera 4 comprises a frame rate of at least 30 frames per second to capture images of the energy spike due to the projectile impact. In another embodiment, thermal camera 4 further comprises a frame rate of at least 60 frames per second. In a further embodiment, thermal camera 4 further comprises a frame rate 500 or more frames per second. There are several commercially available examples of thermal cameras 4 that can be used with the training system. One such commercial example is the M3000 Thermal Imaging Module manufactured by DRS Nytech Imaging Systems, Inc. Thermal camera 4 may contain a software interface, e.g. a software interface manufactured by Lumenera, Inc.

The system further comprises computer 5 to interpret and analyze the thermal images detected by sensor 4. Preferably, computer 5 comprises 512 megabytes (MB) of dynamic random access memory (DDR), 40 gigabytes (GB) of hard drive capacity, and a processing speed of at least 3 gigahertz (GHz). Computer 5 is connected to sensor 4 through a universal serial bus (USB 2.0) or comparable interface. Computer 5 comprises software adapted to receive the images captured by sensor 4, triggered, e.g., by clicking a mouse. Computer 5 further comprises distortion calculation software which can be used to calculate the actual pixel coordinates 9 (FIG. 2) of projectile impact 10. Once computer 5 calculates the actual pixel coordinates 9, its software programs can digitally illustrate the impact coordinates, e.g. for projection onto screen 3. These illustrations are digitally transmitted to one or more feedback devices comprising projector 6, monitor 7, printer 8 or any other device capable of receiving digital signals. Computer 5 further comprises software programs that trigger virtual training scenarios 12 (FIG. 3).

In its preferred embodiment, sensor 4 is calibrated so that computer 5 connected to sensor 4 uses only the images relayed by sensor 4 to determine impact coordinates 9 (FIG. 2). Calibration also compensates for the distortions produced by sensor 4, e.g. from its lens, and extrinsic factors such as the placement of sensor 4 relative to screen 3. Computer 5 can relate the pixel coordinates 9 from a projected target 20 (FIG. 3) to calibrated logical virtual screen coordinates that can then be used by the operating system of computer 5 to determine actual impact coordinates 9.

Sensor 4 may be placed at an angle to screen 3, that is, in front of screen 3 and to the left or right, directly in front of screen 3, looking down at screen 3, and the like. Sensor 4 does not have to be able to see the entire projected target 20 (FIG. 3). Computer 5 can define its own viewable area within the area defined by screen 3. For example, if the entire projected target 20 is not viewable, then only the viewable areas of screen 3 are calibrated. But, for example, if projected target 20 is on screen 3 that has borders containing materials that do not reflect light well, projectile impact 10 in that border space may nevertheless be detected by sensor 4.

The calculation software can also calculate and compensate for the radial and tangential distortions caused by the lens of sensor 4. To find the coordinates to be used in the distortion calculation software library, the system projects an arbitrary number of evenly spaced vertical lines and horizontal lines onto screen 3, one at a time. The system attempts to create these lines so that they encompass the entire projected area. This ensures accuracy in calculating the impact coordinates. If the coordinates cannot be found, then the system adjusts the size, position, and pixel width of the lines until a predetermined accuracy error percentage threshold is reached.

The system next projects a "black" image onto screen 3. The pixel values from the black projected image are subtracted from the pixel values of the vertical projected image and the horizontal projected image. If both images produced by the subtraction contain pixels at the same place and their values are greater than an experimental threshold, their intersection defines one pixel coordinate. After all coordinates have been calculated in this manner, they are stored and processed in the one or more distortion calculation software libraries. The system also captures and stores thermal images comprising information on the baseline temperatures of each logical screen coordinate. When projectile 2 impacts screen 3, energy is transferred to screen 3. Thermal images of screen 3 are continually captured by sensor 4 and processed against the stored baseline screen images. If the current thermal images show a deviation from the captured thermal images, projectile impact 10 is registered.

Once the intrinsic parameters of sensor 4 are known, the extrinsic parameters of the system can be determined. Two vertical lines and two horizontal lines are projected onto the one or more screens 3, with each line in each set of lines being spaced apart at a predetermined distance, e.g. as far apart as possible. The same process described above is used to determine the intersection between the set of lines. These coordinates are then undistorted using the distortion calculation software library with the parameters found above. This process results in the determination of four undistorted corner coordinates of the projected image.

The corner coordinates and the coordinates contained in the quadrilateral defined by the four corners must also be related to coordinates within surface area 3*a* of screen 3. A matrix capable of translating each coordinate to satisfy the above condition is created. The matrix is created as follows. The variables required consist of the captured corner coordinates determined above and the "ideal" coordinates defined by the surface area of screen 3. Starting with the ideal coordinates, the two-dimensional perspective matrix defined by those coordinates is calculated. The matrix is used to transform the captured coordinates. Next, the deviation between each transformed captured coordinate and the relative ideal coordinate is calculated. This deviation is the absolute value of the difference between each relative X and Y coordinate. Each deviation is added to the appropriate component of the last set of coordinates used to find the perspective matrix. Those coordinates are then used in the next calculation of the perspective matrix, and this process is carried out until an arbitrary combined deviation is reached or a maximum number of iterations have been run.

The logical screen position for each coordinate from a captured image may be determined by "undistorting" it using the distortion calculation software library, and then transforming the undistorted coordinate by the matrix found above. The undistorted and transformed coordinate may be out of bounds of the virtual screen space.

The system further comprises an image-generating device, e.g. 6, which may comprise a liquid crystal display (LCD) projector, a digital projector, a digital light processing projector, a rear projection device, a front projection device, or the like, or a combination thereof. In one embodiment, the system comprises LCD projector 6. An image is formed on the liquid crystal panel of the LCD projector 6 from a digital signal from computer 5, for instance. This formed image is then displayed onto screen 3.

The system further comprises a plurality of training scenarios 12 (FIG. 3) that aid in skills training. These training scenarios 12 may comprise video scenarios, digital animation, two- and three-dimensional pictures and other electronic representations that may be projected onto the one or more screens 3. Depending on projectile impact coordinates 9, training scenarios 12 can lead or branch into several possible outcomes beginning from one initial scene. Trainees may pause or replay the completed scene to show the precise impact time and projectile impact coordinates 9 and thereby allow for detailed discussion of the trainee's actions. Training scenarios 12 comprise anticipated real-life situations comprising arrests by law enforcement personnel, investigative scenarios, courthouse scenarios, hostage scenarios and traffic stops. The training scenarios also aid in judging when the use of force may be justified and/or necessary by showing the expected outcomes from projectile impact 10.

In one embodiment, one or more targets 20 (FIG. 3) are projected onto one or more screens 3 or display surfaces using a projection device such as projector 6 or any another graphics generating device that can project target 20 or training scenario 12. Targets 20 can comprise virtual targets. Projectile 2, launched from projectile launching device 1, penetrates or impacts targets 20 at impact 10. Calibrated sensor 4 is directed at screen 3. When projectile 2 impacts the front surface 3*a* of screen 3, an energy spike or change in temperature is detected at screen surface 3*a*. Sensor 4 continually captures thermal images of screen 3 and processes these thermal images against baseline thermal images of screen surface 3*a*. Sensor 4 registers an impact when a deviation from the baseline is observed. Sensor 4 then isolates the impact images from the other captured screen images. The isolated impact images are transmitted to computer 5 connected to sensor 4. Since computer 5 only receives images of the actual impact 10, it does not have to process superfluous thermal images of screen surface 3*a* in order to detect an impact 10. This greatly improves processing speed. Sensor 4 is calibrated so that computer 5 is able to detect actual pixel coordinates 9 of projectile impact 10 relative to projected target 20. Computer 5 further comprises software to digitally illustrate the impact coordinates 9. Feedback devices comprising monitors 7, printers 8 or other electronic devices capable of receiving a digital signal from computer 5 may be used to visually or graphically depict impact coordinates 9. Impact coordinates 9 may also be projected, e.g. by using the projector 6 onto screen 3.

The system further comprises simulated training scenarios 12 that are triggered by computer 5 upon the calculation of the actual projectile impact coordinates 9. Training scenarios 12 comprise video, digital animation or other virtual compilations of one or more situations that simulate real-life conditions. These situations may comprise hostage scenarios, courthouse encounters, traffic stops and terrorist attacks. Each training scenario 12 may further comprise a compilation of one or more scenes. The scenes are compiled in such a manner that any given scene may further branch into one or more scenes based on input from computer 5 regarding the calculated impact coordinates 9. The branching simulates expected outcomes in similar real life situations. Impact coordinates 9 may further be superimposed against, e.g., a graphic of a body of target 20, and the coordinates "frozen" for the trainee to visually inspect the extent of any deviation from the expected shot location. Training scenarios 12 may also be used to display collateral damage that may be expected in real life situations.

The system may further comprise one or more projectile launching devices 1 comprising laser-triggering devices. These laser-triggering devices 1 may be used to fire one or more projectiles 2 comprising lased light at screens 3. The system further comprises software to detect the location of laser device 1 that launched a particular laser at screen 3.

In yet another embodiment, the system comprises thermal sensor 4 comprising thermal camera 4 directed at screen 3. Thermal camera 4 comprises software to detect and isolate thermal images of projectile 2 impacting 10 screen 3. Thermal camera 4 transmits the impact images to a connected computer 5. Computer 5 is connected to thermal camera 4 through an USB 2.0 or comparable interface. Thermal camera 4 is calibrated so that the attached computer 5 can compute impact coordinates 9 relative to predetermined logical screen coordinates. Impact coordinates 9 are sent to feedback devices comprising projectors 6, printers 8, monitors 7 or other electronic devices capable of receiving a digital signal from computer 5. The feedback devices can visually or graphically illustrate impact coordinates 9. The system further comprises training scenarios 12 that comprise a compilation of imagery comprising video and animation figures. The scenes are compiled to simulate real-life incidents, such as hostage situations and traffic stops, which are encountered by the law enforcement and military personnel. The system comprises software that upon notification of the impact coordinates 9 further branches into one or more possible outcome based scenarios. These outcome-based scenarios simulate real life responses. The system may further comprise a video editor. The trainee can film their own video clips and import them into the editor. The imported video is converted into MPEG-4 or comparable format. The trainee can then create training scenarios 12 comprising branching points as desired. Branching conditions that are correlated to the coordinates of the projectile impact may also be defined. The trainee may ultimately group multiple training scenarios 12 together to present diverse training situations in a single training session.

In another embodiment, thermal camera 4 continually captures current thermal images of screen surface 3*a*. Computer 5 connected to thermal camera 4 receives these thermal images, e.g. as mouse clicks. Computer 5 processes these images against baseline thermal images of screen surface 3*a*. If computer 5 detects a deviation from the baseline, an impact is registered. Computer 5 further comprises software to calculate the impact coordinates 9 of projectile 2 from the impact images. Once impact coordinates 9 have been calculated, they are sent to feedback devices connected to computer 5.

In the operation of preferred embodiments, one or more projectiles 2 are launched at one or more targets 20 (FIG. 3) projected onto one or more screens 3. Sensor 4, e.g. thermal camera 4, is directed at screen 3 comprising the projected targets 20. Thermal camera 4 continually detects and captures thermal images of screen surface 3*a* (FIG. 1) and registers a projectile impact 10 by comparing current thermal images of screen surface 3*a* with one or more previously captured baseline thermal images of screen 3. Any deviation from the baseline is attributable to the energy change caused by the projectile impact. Thermal camera 4 isolates the impact images and transmits them to computer 5. Computer 5 may be connected to thermal camera 4 through a USB 2.0 or comparable interface. Thermal camera 4 is calibrated so that computer 5 can calculate the actual impact coordinates 9 relative to projected target 20. Computer 5 further comprises software to convert impact coordinates 9 into digital signals. Feedback devices, e.g. monitor 7, printer 8 or any other electronic device that can receive a digital signal from computer 5, can be used to visually or graphically depict the impact coordinates. The impact coordinates can be displayed along a virtual X-axis 10 and a virtual V-axis 11 projected on screen surface 3*a*. Projector 6 may be used to project images of impact coordinates 9 onto screen 3 for immediate visual feedback to the trainee. Upon notification of the calculated projectile impact coordinates 9 by computer 5, the software, which comprises outcome based training scenarios 12, is triggered. These training scenarios 12 comprise a compilation of scenes that simulate real life responses or outcomes to a projectile impact. Projector 6 or monitor 7 may further be used to project these training scenarios 12 onto screen 3.

In certain of the embodiments discussed above, the position of projectile 2 impacting a simulated environment, e.g. on screen 3, is determined by using thermal camera 4 to capture a baseline thermal image of screen 3 using a predetermined set of coordinates of screen 3. A simulated three dimensional image is also projected onto screen 3, where, at some point in time, the simulated three dimensional image further comprises one or more targets 20, each of which may move independently of the other targets 20 within the simulated training scenario 12. Projectile 2 is then launched at target 20 projected onto screen 3, e.g. from gun 1, and impacts screen 3, leaving a heat signature on screen 3. Thermal camera 4 detects a heat signature left by projectile 2 impacting screen 3. Using the heat signature, computer 5 calculates a set of actual pixel coordinates of impact point 10 of projectile 2 on screen 3. A first predetermined set of environmental characteristics that can affect the traveling of a simulated projectile in the simulated three dimensional space are calculated and a projectile path within the simulated virtual space is determined using the actual projectile impact point 10 in physical space, the first predetermined set of environmental characteristics, and a second predetermined set of physical characteristics of the projectile from physical space. As discussed above, these environmental characteristics may include wind, distance, air density, object density, gravity, and the like, or a combination thereof. A simulated projectile path is then projected through the simulated three dimensional space onto screen 3 based upon the determined projectile path.

A zone of probable impact of projectile 2 with target 20 may also be determined, e.g. calculated, within the simulated virtual space using the first predetermined set of environmental characteristics, the second predetermined set of physical characteristics of the projectile from physical space, and a third predetermined set of simulated characteristics of target 20 within the simulated three dimensional space. A visual representation of this zone of probable impact may then be projected onto screen 3. In currently contemplated embodiments, a plurality of projectiles 2, each from a independent source 1, may be fired at screen 3 more or less simultaneously with a simulated projectile path for each projectile 2 projected through the simulated three dimensional space onto screen 3 based upon the determined projectile path for each of the plurality of projectiles 2. Similarly, with or without such a plurality of projectiles 2, a simulated three dimensional image may be projected onto screen 3 where the simulated three dimensional image comprises a plurality of targets 20 where a predetermined number of targets 20 are provided with independent movement within at the three dimensional virtual space. The movement of these targets 20 may be random.

In certain embodiments, a predetermined number of objects within the simulated three dimensional virtual space may be influenced in real time by the first predetermined set of environmental characteristics, e.g. trees or grass or other such objects.

The foregoing description is illustrative and explanatory of several embodiments of the invention, it will by understood by those skilled in the art that various changes and modifications in form, materials and detail may be made therein without departing from the spirit and scope of the invention.

The invention claimed is:

1. A system for projecting coordinates of a physical projectile impact from a real physical space into a three dimensional virtual space, the system comprising:

a. an elastomeric screen dimensioned and configured to receive a physical projectile travelling through the physical space;

b. a projector adapted to visually project a three dimensional virtual space image comprising a target onto the elastomeric screen, the three dimensional virtual space image further comprising images simulating a three axis view from the point of view of a viewer outside the screen;

c. a camera directed at the screen, the camera adapted to substantially continually capture a thermal image of the elastomeric screen;

d. at least one computer operatively in communication with the camera, the at least one computer comprising an image processor adapted to receive images captured by the camera; and e. software operatively resident in the at least one computer, the software comprising:

i. a simulator adapted to create the projectable virtual space image;

ii. a physical impact coordinate calculator adapted to use the images received from the camera to determine a physical impact point of the physical projectile with the elastomeric screen;

iii. an environmental factoring module adapted to calculate an effect of a predetermined set of environmental characteristics on an object located within the virtual space in real time;

iv. a virtual impact coordinate calculator adapted to use the physical impact point, the calculated environmental effects, and one or more physical characteristics of the physical projectile within the physical space to translate the physical projectile into a virtual projectile within the three dimensional virtual space and to calculate a virtual impact point for the virtual projectile relative to the projected target in real time; and v. an illustrator dimensioned and configured to create a digital illustration of the virtual projectile as the physical projectile transits from physical space into the three dimensional virtual space, including computing an effect of a virtual object in the three dimensional virtual space on the virtual projectile as it moves through the three dimensional virtual space.

2. The system of claim 1, wherein the simulator creates a human perceptible illusion that the target appears to move within the simulated three dimensional virtual space.

3. The system of claim 1, wherein the target further comprises a plurality of targets, a predetermined number of which move independently of the movement of other targets within the simulated three dimensional virtual space.

4. The system of claim 1, wherein the camera is a thermal camera.

5. The system of claim 1, wherein the camera operates at a capture rate exceeding 500 frames per second.

6. The system of claim 1, wherein the projectable three dimensional virtual image comprises photographic images and simulated photographic images.

7. The system of claim 1, wherein the predetermined set of environmental characteristics comprise at least one of wind, distance, air density, object density, or gravity.

8. The system of claim 1, wherein the illustrator further comprises a module adapted to project an image suitable for aiming the projectile at a location in the simulated three dimensional virtual space where the virtual projectile is likely to strike the target within the simulated three dimensional virtual space.

9. The system of claim 1, further comprising:

a. a motion detector; and b. a motion detection software module in communication with the motion detector and the virtual impact coordinate calculator, wherein:

i. the motion detection software module is adapted to determine a position of a projectile releasing device at the instant that the projectile releasing device fires the physical projectile; and ii. the virtual impact coordinate calculator is further adapted to use the detected position of the projectile releasing device while calculating the virtual impact point relative to the projected target in real time.

10. A method for determining the position of a physical projectile impact into a simulated environment, the method comprising:

a. using a camera to capture a baseline thermal image of an elastomeric display screen using a predetermined set of coordinates of the screen;

b. projecting a simulated three dimensional image onto the screen, the simulated three dimensional image illustrating a simulated three axis view of a virtual space from the point of view of a viewer outside the screen and comprising an image of a target;

c. receiving, by the elastomeric display screen, a physical projectile launched at the target projected onto the screen;

d. using the camera to detect a heat signature left by the physical projectile impacting the screen;

e. calculating a set of actual pixel coordinates of the physical projectile impact using the heat signature;

f. calculating a first predetermined set of environmental characteristics that can affect the traveling of a simulated projectile into the simulated three dimensional virtual space;

g. determining a simulated projectile path during translation of the physical projectile to a simulated projectile within the simulated three dimensional virtual space using the physical projectile impact point in physical space, the first predetermined set of environmental characteristics, and a second predetermined set of physical characteristics of the physical projectile from physical space; and h. determining a virtual impact point of the simulated projectile within the simulated three dimensional virtual space based upon the determined simulated projectile path.

11. The method of claim 10, further comprising calibrating the camera to compensate for lens distortion.

12. The method of claim 10, wherein determining a virtual impact point comprises determining a zone of probable impact of the simulated projectile with the target within the simulated three dimensional virtual space using the first predetermined set of environmental characteristics, the second predetermined set of physical characteristics of the physical projectile, and a third predetermined set of simulated characteristics of the target within the simulated virtual space, and further comprising:

projecting a visual representation of the zone of probable impact onto the screen.

13. The method of claim 10, wherein the first predetermined set of environmental characteristics comprises at least one of wind, distance, air density, object density, or gravity.

14. The method of claim 10, wherein a predetermined number of objects within the simulated three dimensional virtual space are influenced in real time by the first predetermined set of environmental characteristics.

15. The method of claim 10, further comprising:

a. receiving, by the screen, a plurality of projectiles, each launched from a respective independent source; and b. projecting a respective simulated projectile path through the simulated three dimensional virtual space onto the screen based upon the determined projectile path for each of the plurality of projectiles.

16. The method of claim 10, wherein projecting a simulated image comprises projecting a simulating image comprising a plurality of targets, and further comprising:

providing independent movement of a predetermined plurality of the targets within the three dimensional simulated virtual space.

17. The method of claim 16, wherein the independent movement is random.

18. A system comprising:

a screen configured to receive a physical projectile travelling through a physical space;

a projector adapted to project a three dimensional virtual space image comprising a target onto the screen, the three dimensional virtual space image further comprising images simulating a three axis view from the point of view of a viewer outside the screen;

a camera configured to capture a thermal image of the screen; and at least one computer in communication with the camera and the projector, the at least one computer configured to execute software to:

generate the three dimensional virtual space image projected by the projector;

determine, based upon data received from the camera, coordinates for a physical impact of the physical projectile with the screen;

determine one or more physical characteristics associated with the travel of the physical projectile through the physical space; and translate, based at least in part upon the physical impact coordinates and the one or more physical characteristics, the physical projectile from the physical space into a virtual projectile in a virtual space associated with the three dimensional virtual space image; and determine, based at least in part upon the one or more physical characteristics and one or more simulated characteristics associated with the target, movement of the virtual projectile within the three dimensional virtual space and a virtual impact point of the virtual projectile within the three dimensional virtual space.

* * * * *